United States Patent [19]

Elliott

[11] 4,073,737

[45] Feb. 14, 1978

[54] HYDROGENATED COPOLYMERS OF CONJUGATED DIENES AND WHEN DESIRED A VINYL AROMATIC MONOMER ARE USEFUL AS OIL ADDITIVES

[75] Inventor: Robert L. Elliott, Scotch Plains, N.J.

[73] Assignee: Exxon Research & Engineering Co., Linden, N.J.

[21] Appl. No.: 678,144

[22] Filed: Apr. 19, 1976

[51] Int. Cl.[2] ..... C10M 1/32

[52] U.S. Cl. ..... 252/51.5 A; 252/56 R; 252/59

[58] Field of Search ..... 252/51.5 A, 56 R, 59

[56] References Cited

U.S. PATENT DOCUMENTS

| | | | |
|---|---|---|---|
| 2,688,643 | 9/1954 | Dean et al. | 252/59 X |
| 3,646,142 | 2/1972 | Strobel | 252/59 X |
| 3,752,767 | 8/1973 | Eckert et al. | 252/59 |
| 3,772,196 | 11/1973 | St. Clair et al. | 252/59 X |
| 3,795,615 | 3/1974 | Pappas et al. | 252/59 |
| 3,948,843 | 4/1976 | Saint-Pierre et al. | 252/59 X |

FOREIGN PATENT DOCUMENTS

| | | | |
|---|---|---|---|
| 769,281 | 3/1957 | United Kingdom | 252/59 |

*Primary Examiner*—Delbert E. Gantz
*Assistant Examiner*—Andrew H. Metz
*Attorney, Agent, or Firm*—Roland A. Dexter; Frank T. Johmann

[57] ABSTRACT

A hydrogenated copolymer produced by copolymerization of from about 1 to about 10 mol percent butadiene and at least one other $C_5$ to $C_{12}$ conjugated diene, and, if desired, in order to provide a block copolymer, up to 45 mole percent of a vinyl aromatic monomer, upon addition to lubricating oils containing a pour point depressing amount of an oil-soluble polymeric pour depressant, provides viscosity modification, oxidative and shear stability with excellent low temperature viscometric properties.

11 Claims, No Drawings

HYDROGENATED COPOLYMERS OF CONJUGATED DIENES AND WHEN DESIRED A VINYL AROMATIC MONOMER ARE USEFUL AS OIL ADDITIVES

BACKGROUND OF THE INVENTION

1. Field of the Invention

This invention relates to polymeric oil additives and to lubricating oil compositions containing these additives. More particularly, the present invention relates to hydrogenated, block copolymers of butadiene and another conjugates diene and, if desired, a vinyl aromatic monomer and their addition to lubricating oil compositions containing pour depressants with minimal affect on the pour point of said compositions.

2. Description of the Prior Art

Various copolymers of butadiene with other olefins are known as oil additives. Thus, U.S. Pat. No. 3,419,365 teaches hydrogenated copolymers of butadiene and styrene as pour point depressants for distillate fuel oil. Similarly, U.S. Pat. No. 3,393,057 teaches copolymers of butadiene, $C_{10}$ to $C_{24}$ normal alpha-monoolefins and styrene or indene as pour point depressants for fuel and lubricating oils. U.S. Pat. No. 3,635,685 discloses pour point depressants comprising hydrogenated butadiene-styrene copolymers which contain a hydroxy, carboxy, or pyridyl terminal group.

U.S. Pat. No. 3,312,621 discloses copolymers of various conjugated diolefins, including butadiene and isoprene which are predominantly in the 1,4-addition configuration as viscosity index (V.I.) improvers for lubricating oils.

Other styrene-diene copolymers have been reported for possible use in lubricants, including U.S. Pat. No. 3,772,196 which shows lubricating oil compositions for internal combustion engines containing a combination of block copolymers comprising a first polymer block of an alkenyl arene, e.g. styrene, and a second essentially completely hydrogenated polymer block of isoprene and certain pour point depressants in a lubricant base stock; and, U.S. Pat. No. 3,795,615 which teaches that a hydrogenated copolymer of butadiene and isoprene may be incorporated into mineral oil containing a polymeric pour point depressant to improve the viscosity index of the lubricating oil blend.

SUMMARY OF THE INVENTION

It has been found that there is a type of copolymer which is highly useful in a viscosity modifier in lubricating oils containing a polymeric pour point depressant since it provides excellent low temperature viscometric performance to the blended oil while retaining the desired levels of shear and oxidative stability. This type of copolymer is an oil-soluble copolymer of the following general formula $$(A)_x(B)_y(C)_z$$

wherein:

A is a conjugated diene of the formula $$CH_2{=}CH{-}\overset{\overset{R}{|}}{C}{=}CH_2$$

wherein R is a $C_1$ to $C_8$ alkyl group, preferably $CH_3$, i.e. isoprene, and present in mole % proportion as indicated by $x$ which may vary from 45–99 mole %;

B is butadiene and present in mole % proportion as indicated by $y$ which may vary from 1–10, preferably 2–9, mole %; and C is a $C_8$ to $C_{20}$ monovinyl aromatic compound and/or aromatic substituted diene and present in weight % proportion as indicated by $z$ which may vary from 0 to 45 mole %; preferably 5 to 40 mole %, and optionally 25 to 30 mole % whereby the most useful composite properties of oxidative stability and −18° C. viscosity of the lubricating oil blend is realized.

Thus, this invention in its broadest form can be characterized as a lubricating oil composition comprising:

a. a major amount of a mineral lubricating oil;

b. a minor but effective amount of a polymeric pour point depressant for said oil; and c. 0.1–30 percent by weight of a copolymer having the structure $$(A)_x(B)_y(C)_z$$

wherein:

A is a conjugated diene of the formula $$CH_2{=}CH{-}\overset{\overset{R}{|}}{C}{=}CH_2$$

wherein R is a $C_1$ to $C_8$ alkyl group, preferably $CH_3$, optimally isoprene and present in mole % proportion as indicated by $x$ which may vary from 45 to 99 mole %;

B is butadiene and present in mole % proportion as indicated by $y$ which may vary from 1 to 10 mole %; and C is a $C_8$ to $C_{20}$ monovinyl aromatic monomer, preferably styrene, and present in mole % proportion as indicated by $z$ which may vary from 0 to 45 mole %. It is preferred that about 75 to 95 percent of the diene monomers are in the 1,4-configuration in the block copolymer and that substantially all of the olefinic bonds are saturated as by hydrogenation.

In a more restricted sense, this invention is concerned with a lubricating oil composition comprising:

a. a major amount of a mineral lubricating oil;

b. a minor but effective amount of an oil-soluble polymeric pour point depressant for said oil; and c. 0.1–10 percent by weight of a hydrogenated block copolymer having the structure $$(A)_x(B)_y(C)_z$$

wherein:

A is isoprene and present in mole % proportion as indicated by $x$ which may vary from 50 to 94 mole %;

B is butadiene and present in mole % proportion as indicated by $y$ which may vary from 1 to 10 mole %; and C is styrene and present in mole % proportion as indicated by $z$ which may vary from 5 to 40 mole %.

DETAILED DESCRIPTION

A block copolymer according to this invention is a copolymer obtained by anionically copolymerizing in hydrocarbon solution the monomers of butadiene and at least one other conjugated diene in the present of an alkali metal or an alkali metal compound as a catalyst until at least 99% of the monomers have been incorporated into the copolymer and thereafter, if desired, incorporating a polymer block of a monovinyl aromatic monomer. In contrast to a block copolymer, anionic copolymerization of a mixture of 1 to 10 mole percent butadiene and from 90 to 99 mole percent of another conjugated diene (A of the formula) provides a copolymer; another useful form of this invention.

The block copolymer differs materially from the tapered-block copolymer disclosed in my copending U.S. patent application Ser. No. 673,070, filed Apr. 2, 1976 (having the title Hydrogenated Tapered-Block Copolymers of Conjugated Dienes and a Vinyl Aromatic Monomer are Useful as Oil Additives (PT-298) which is obtained by the polymerization of a mixture of conjugated dienes and a vinyl aromatic monomer. Since the tendency of the conjugated dienes to be incorporated into the anionic copolymer greatly exceeds that of the monovinyl aromatic monomer, the composition of each tapered-block copolymer molecule formed during copolymerization gradually changes from that of nearly pure polydienes to that of nearly pure poly-monovinyl aromatic. Therefore, in these linear tapered-block copolymer molecules, three longitudinal regions can be discerned which gradually pass into each other and have no sharp boundaries. In contrast, the block copolymers utilized in this invention have a boundary which is sharp and discrete between the conjugated dienes and vinyl aromatic (when it is utilized to enhance oxidation stability of the block copolymer). It is desirable for "single" block copolymers that the outer region consist of a homopolymeric block of units derived from C (the monovinyl aromatic monomer) and that less than a few units, e.g., no more than about 1 wt. % of A and B (conjugated dienes) are present therein.

The copolymers and block copolymers of the present invention may be conveniently prepared with known metallic or organometallic catalysts such as lithium metal or sodium metal and organo-lithium or organo-sodium catalysts. Suitable organo-lithium catalysts may be represented by the formula RLi wherein R is a $C_1$ to $C_{20}$, e.g., $C_2$ to $C_8$, hydrocarbyl, e.g., alkyl, aralkyl or cycloalkyl group. Specific examples of suitable catalysts include n-propyllithium, isopropyllithium, n-butyllithium, tertiary butyllithium, etc. with n-butyllithium being preferred, whereby 85 to 90% of the diene mixture within the copolymer is in the optimal 1,4-microstructural configuration.

The solution copolymerization may be carried out at any desired temperature in the range from −50° C. to +150° C., and is preferably effected at a temperature between −20° C. and +80° C. The solvents used in polymerization are, in preferred form, hydrocarbon solvents such as pentane, hexane, heptane, cyclohexane, benzene, toluene, xylene and ethyl benzene, with benzene and hexane being the preferred species.

The polymerization can be carried out under any pressure, but since it is desirable to maintain the monomers and the solvent substantially in the liquid phase, the pressure applied is preferably at least sufficient to keep the monomers and the solvent in the liquid state. The pressure to be applied thus will depend on the temperature of the copolymerization and on the types of monomers and solvent components used. If desired, higher pressures can be used, for instance by pressurizing with an inert gas, such as nitrogen.

The molecular weight of the hydrogenated copolymers of the mixed conjugated dienes and, if desired, the monovinyl aromatic compound which after hydrogenation are to be used as components of the lubricant compositions according to the invention may vary between wide limits, for instance between 2,000 and 500,000, preferably between 10,000 and 150,000. These are expressed as number average molecular weights, determined by membrane osmometry (for $(\overline{M}n) > 5000$) or vapor pressure osmometry (for $(\overline{M}n) < 5000$) methods.

The $(\overline{M}n)$ is regulated by the ratio of the number of moles of catalyst (e.g., butyllithium) to the number of moles of monomers present during polymerization; the number of units originating from the monomers in a polymer molecule is substantially equal to the ratio of the number of moles of monomer to the number of moles of catalyst (assuming that each catalyst molecule contains one alkali metal atom) present during polymerization, provided that no contaminants which give rise to side reactions with the catalyst (such as oxygen, water, carbon dioxide) are present. If single block copolymers are coupled together, the multiple block copolymers formed have molecular weights which can be calculated from the molecular weight of the single block copolymers (determined as above) and the number thereof which are coupled together.

When the copolymerization has been completed, the block copolymer thus obtained can be hydrogenated either immediately or after recovery to obtain the desired hydrogenated block copolymers according to the invention.

Methods of hydrogenation well known to one skilled in the art are applicable. For example, any material functioning as an olefin hydrogenation catalyst can be used to incorporate hydrogen into the olefinic bonds; suitable catalysts include Raney nickel, platinum oxide, platinum on alumina, palladium on charcoal, copper chromate, nickel supported on kieselguhr, etc.

Hydrogenation should be carried out until at least 90%, preferably 95%, of the olefinic double bonds but not more than 5% of the aromatic unsaturation has been saturated.

After bringing the copolymerization to an end, the copolymer can be recovered in any desired way, for instance by precipitation which can be effected by addition of relatively large amounts of non-solvents for the copolymer such as an alcohol, e.g., methanol, ethanol or isopropanol. Recovery is not generally useful since the copolymer of the invention is most likely utilized as an oil additive wherein the copolymer is formulated into the hydrocarbon lubricating oil as an oil concentrate of said copolymer obtained indirectly from said hydrogenation step, e.g., by dilution with oil followed by evaporation of the low boiling hydrocarbon solvent.

The block copolymer as used herein includes "multiple block copolymers" which term denotes copolymers consisting of two or more of the single block copolymers described above, which are bound to each other. A multiple block copolymer may, for example, be prepared by first copolymerizing to completion a mixture of butadiene and isoprene, thereafter polymerizing styrene onto said copolymer and subsequently sequentially copolymerizing a mixture of butadiene and isoprene followed by said styrene onto the "living" block copolymer. For purposes of this disclosure, a "living" copolymer is one which remains stable over an extended period of time during which additional monomers can be added to it.

Multiple block copolymers can also be obtained in other ways such as by coupling of two or more "living"

block copolymer molecules. This can be achieved by addition of a compound which reacts with two or more "living" single block copolymer molecules. Examples of this type of compound include compounds containing two or more ester groups, compounds with more than one active halogen atom, e.g., di- and trichloromethyl-benzene, phosgene, dichlorosilane, carbon tetrachloride, dimethyldichlorosilane, 1,2-dichloroethane, 1,2-dibromomethane, and the like. Another possible method for preparing multiple block copolymers consists in the preparation of single block copolymer containing a reactive group in the molecule (e.g., a carboxyl group, which is, for example, obtained by bringing the polymerization of a single copolymer to an end by addition of carbon dioxide) and coupling of two or more of the molecules, e.g., by esterifying them with a di- or polyvalent alcohol. Multiple block copolymers have the further advantage that they can be tailored to provide the most useful additive properties while masking one or more undesirable properties inherent in any polymer block.

POLYMERIC POUR POINT DEPRESSANTS

Many substances are known for their pour point depressant activity in lubricating oils. The activity of these substances, however, can be decreased by the adverse influence of the polymeric V.I. improver. Oftentimes then the compounded lubricating oil represents a compromise of the chemical and physical properties so as to have suitable operational characteristics. This comprises features which are quite characteristic of multigrade lubricating oils.

It has been discovered that the hydrogenated copolymers including the block copolymers of the invention can provide multi-functional V.I. improvement in lubricating oils blended with polymeric pour depressants without deleterious effect on the pour point of said blended lubricating oils.

Oil-soluble polymeric pour depressants for lubricating oils have been widely disclosed in the art, e.g.: U.S. Pat. No. 2,379,728 shows olefin polymers; U.S. Pat. No. 2,460,035 shows polyfumarates; U.S. Pat. No. 2,936,300 shows copolymers of dialkyl fumarate and vinyl acetate; and, U.S. Pat. No. 2,542,542 shows copolymers of olefins and maleic anhydride esterified with a long chain alcohol.

Illustrative pour point depressants also include copolymers of alpha-olefins and terpolymers of alpha-olefins and styrene and/or alkyl styrenes. Those polymeric pour depressants preferably used in accordance with this invention are the alkyl aromatic compounds, ester base polymers and ester-imides of copolymers of styrene and maleic anhydride.

THE LONG CHAIN ALKYL AROMATIC CONDENSATION MATERIALS

These materials are usually made by the Friedel-Crafts condensation of a halogenated paraffin or an olefin with an aromatic hydrocarbon. They are well known in the art, primarily as lube oil pour depressants and as dewaxing aids as previously mentioned. Usually, the halogenated paraffin will contain from about 15 to about 60, e.g. 16 to about 50 carbons, and from about 5 to about 25 wt. %, e.g. 10 to 18 wt. %, chlorine. Typically, the halogenated paraffins are prepared by chlorinating to the above recited chlorine content a paraffin wax having a melting point within the range of about 38° to 94° C. The aromatic hydrocarbon used usually contains a maximum of three substituent groups and/or condensed rings. It may be a hydroxy compound such as phenol, cresol, xylenol, or an amine such as aniline, but is preferably naphthalene, phenanthrene or anthracene. These long chain alkyl-aromatic hydrocarbon, usually alkylated naphthalene, condensation products and their preparation are fully described in U.S. Pat. Nos. 1,815,022; 1,963,917; 1,963,918; 2,062,354; 2,087,682; and 2,174,246, all of which are incorporated herein by reference thereto.

ESTER BASE POLYMERS

Usually these oil-soluble ester base polymers will have molecular weights in the range of 5,000 to 1,000,000, preferably 10,000 to 500,000 and most preferably 15,000 to 200,000 number average molecular weight (Mn). These ester base polymers are derived essentially, e.g. 80 wt. % or more of the total polymer, from $C_8$ to $C_{20}$, preferably $C_{12}$ to $C_{18}$, alkyl esters of a $C_3$ to $C_8$, preferably $C_3$ to $C_5$ mono- or dicarboxylic, monoethylenically unsaturated acid. Polymers of this ester type are well known in the art and are usually made by free radical initiation, e.g., a peroxide, in a solvent.

Such esters from which the polymer is essentially derived include: alkyl acrylate; alkyl methacrylate; dialkyl fumarate; and dialkyl itaconate.

The most common of these oil-soluble esters are polymers of acrylic esters represented by the formula $$CH_2{=}\overset{\overset{\displaystyle R}{|}}{C}{-}COOR'$$

wherein R represents hydrogen or methyl and R′ represents an alkyl group of 8 to 24 carbon atoms. The alkyl group may be essentially straight chain and preferably contains 12 to 18 carbon atoms although methyl and ethyl branching can be tolerated. The term "acrylic ester" in this invention includes both acrylates and methacrylates. Mixtures of both alkyl acrylates and alkyl methacrylates may be used as well as their partial esters.

Lower alkyl acrylic esters, here meaning esters having alkyl groups smaller than 8 carbon atoms and derived from acrylic or methacrylic acid, i.e. methyl, ethyl, propyl, butyl, amyl, and hexyl acrylates and methacrylates may be employed in amounts ranging from 0 to 25 mole % with said $C_{8\text{-}24}$ alkyl esters.

In addition to the one or more of the above vinyl mono- and dicarboxylic esters and the aforementioned lower alkyl acrylic esters, there may be used to form the backbone, in minor amounts, one or more other miscellaneous free radical polymerizable, monoethylenically unsaturated compounds, particularly monovinylidene compounds, such as vinyl esters as vinyl acetate, styrene and alkyl styrenes, vinyl alkyl ethers — which are represented by vinyl butyl ether, vinyl dodecyl ether and vinyl octadecyl ether.

In addition, nitrogen-containing monomers can be polymerized with the foregoing monomers, said nitrogen-containing monomers include those represented by the formula:

$$R{-}\underset{\underset{\displaystyle R_1}{|}}{C}{=}\underset{\underset{\displaystyle R_2}{|}}{C}{-}H$$

wherein $R_1$ and $R_2$ can be hydrogen and/or alkyl radicals and R is a 5- or 6-membered heterocyclic nitrogen-containing ring and which contains one or more substituent hydrocarbon groups. In the above formula, the vinyl radical can be attached to the nitrogen or to a carbon atom in the radical R. Examples of such vinyl derivatives include 2-vinylpyridine, 4-vinylpyridine, 2-methyl-5-vinylpyridine, 2-ethyl-5-vinylpyridine, 4-methyl-5-vinylpyridine, N-vinylpyrrolidone, 4-vinylpyrrolidone, and the like.

The n-alkyl methacrylates are typified by those set forth in U.S. Pat. No. 2,710,842. Copolymers of di-n-alkyl fumarate and vinyl acetate are typified by those set forth in U.S. Pat. No. 3,048,479.

ESTER-IMIDES OF COPOLYMERS OF STYRENE AND MALEIC ANHYDRIDE

This class of useful pour point depressants for lubricating oils are the oil-soluble reaction products of copolymers formed of substantially equimolar portions of maleic anhydride and styrene alone or in admixture with an alpha-olefin such as ethylene, propylene, isobutylene, etc. These copolymers should have a number average molecular weight in the range of about 500 to about 150,000 and can readily be produced according to the teachings of U.S. Pat. No. 2,615,845.

The carboxyl groups of the copolymer must be esterified with at least a sufficient amount to provide oil solubility, preferably at least about 30% but not more than about 95%, of aliphatic alcohol or mixture of alcohols having from about 2 to 26 carbon atoms. Examples of alcohols suitable for use in producing the esters include straight chain normal primary alcohols such as ethyl, propyl, butyl, hexyl, octyl, lauryl octadecyl, eicosyl, docosyl, tricosyl, tetracosyl, pentacosyl, hexacosyl, etc.

Commercially marketed mixtures of alcohols consisting essentially of saturated alcohols of the requisite chain length may be employed in preparing the long chain esters. One such mixture is marketed under the trade name Behenyl alcohol and is a mixture of alcohols derived from natural sources and consists primarily of docosyl and alcohols containing from 16 to 24 carbon atoms per molecule.

The balance of the carboxyl groups are reacted with an alkylamine, preferably a diamine compound of the formula

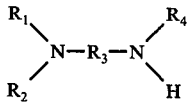

where $R_1$ and $R_2$ are selected from the group consisting of aliphatic hydrocarbon radicals having from 1 to 4 carbon atoms and the cyclohexyl radical, $R_3$ is an aliphatic hydrocarbon radical having from 2 to 4 carbon atoms, and $R_4$ is selected from the class consisting of the hydrogen atom and aliphatic hydrocarbon radicals having from 1 to 4 carbon atoms. Illustrative diamines include: N,N-dimethyl-1,2-ethylenediamine; N,N-dimethyl-1,4-butylenediamine; N,N-dicyclohexyl-1,3-propylenediamine; etc.

The method of making the copolymers and the esterification-amidation or -imidation thereof using alcohol or amines is quite adequately broadly described in the prior art in U.S. Pat. No. 2,615,845 and more specifically in U.S. Pat. No. 3,329,658, and the teachings of these patents are incorporated herein by reference.

The copolymers of the invention can be employed alone in lubricant compositions blended with the polymeric pour depressants or they can be employed in combination with other viscosity improvers. If desired, the copolymers may be employed in combination with other additives, for example ashless dispersants such as the reaction product of polyisobutenyl succinic anhydride with tetraethylene pentamine; detergent type additives, such as barium nonyl phenol sulfide, calcium tertiaryamylphenol sulfide, calcium phenol stearate, calcium petroleum sulfonate, etc. It is contemplated that the inventive copolymers can be blended with other polymers so as to impart various desired properties thereto.

As noted, it is a feature of this invention that viscosity modification and shear and oxidative stability can be imparted to a mineral lubricating oil blended with a polymeric pour depressant with little or no adverse effect on pour point, and in fact with the preferred depressants the pour point of said blend is improved.

The lubricating oil which may be particularly improved by the technique of this invention include the following:

a. Midcontinent having a +15° F. pour point;
b. Midcontinent having a 0° F. pour point;
c. Pennsylvania having a 0° F. pour point; and
d. West Coast having a + 15° F. pour point.

DESCRIPTION OF PREFERRED EMBODIMENTS

The following examples will serve to illustrate methods of preparing the compositions of the present invention and include preferred embodiments of the invention.

EXAMPLE 1

Into a clean, dry, polymerization vessel, under a nitrogen atmosphere, was charged toluene (150 ml) and n-butyllithium (0.55 meq). Butadiene (1.9 g., 0.036 mole) and isoprene (25.0 g., 0.368 mole) were simultaneously added to the vessel cooled to −5° C. Polymerization was initiated by slowly heating the solution to 50° C. The solution was allowed to continue reacting for an additional 30 minutes whereupon there was added, at ambient temperature, styrene (2.0 g., 0.029 mole) in 50 ml of toluene. The resulting solution was slowly heated to 50° C. and allowed to continue reacting for an additional 30 minutes. The reaction was terminated with 3 ml of methanol. The copolymer was isolated by precipitation into 2 liters of methanol containing 0.1 wt. % antioxidant and drying in a vacuum oven at 100° C. for 24 hours. This yielded a clear block copolymer (26.5 g., 88.4% of theoretical yield). This copolymer had an ($\bar{M}n$) of 59,000 (membrane osmometry) with approximately 85% of the diene monomer units in a 1,4 configuration (determined by nuclear magnetic resonance (NMR)).

EXAMPLE 2

Following the procedure of Example 1, isoprene (17.7 g., 0.26 mole), butadiene (9.1 g., 0.168 mole) and styrene (3.0 g., 0.019 mole) were copolymerized with n-butyllithium (0.35 meq) in 250 ml toluene. An isolation procedure as in Example 1 yielded a clear block terpolymer (27.9 g., 93% of theoretical yield) having an ($\overline{M}n$) of 103,000 (membrane osmometry) of about 85% 4-configuration.

EXAMPLE 3

The copolymers of Examples 1 And 2 were in turn subjected to chemical hydrogenation as described in *Die Makromoleculare Chemie,* 163, 1 (1973) and *Die Makromolekulare Chemie,* 163, 13 (1973). This hydrogenation is illustrated with the copolymer of Example 1 as follows:

Into a dry flask, under a nitrogen atmosphere, was carefully placed a sample of 5 g. of said copolymer, xylene (250 ml.) and p-toluenesulfonylhydrazide (TSH) (35 g.) and the resulting solution maintained at reflux (135°-140° C.) under mild agitation for 2 hours. After this time, the solution was hot filtered (about 90° C.), then cooled to ambient temperature and isolated by precipitation from 1500 ml. methanol. The resulting polymer was washed with methanol (500 ml), then dried in a vacuum oven at 100° C. for 24 hours to yield 4.7 g. of a hydrogenated:butadiene (8 mole %); isoprene (85 mole %); styrene (7 mole %) block terpolymer.

EXAMPLE 4

For the hydrogenation of the copolymer of Example 2, the procedure of Example 3 was followed except for the following changes:

7 g. of copolymer was used; 500 ml of xylenes was used; 28 g. of TSH was used; and mild agitation was for 4 hours.

The resulting copolymer yield was 6.4 g. of a hydrogenated:butadiene (35 mole %); isoprene (54 mole %); styrene (11 mole %) block terpolymer.

EXAMPLE 5

To demonstrate their viscosity index improving characteristics, the resulting hydrogenated polymers of Examples 3 and 4 were blended to a viscosity of ca. 12.4 cs. in ENJ-102, a mineral lubricating oil. This oil was a blend of two basic oils which contained 0.5 wt. % of a commercial polymeric pour point depressant. Both oils were paraffinic, solvent refined neutral oils. The first had a viscosity of about 150 SUS at 100° F. and constituted 25.75 weight percent of the blend. The second oil had a viscosity of about 300 SUS at 100° F. and constituted 73.75 wt. % of the blend. Polyisobutylene (Paratone N a commercially available V.I. improver from Exxon Chemical Company, Houston, Texas) was also blended with the test oil for comparison. The stability of the several lubricating oil test compositions was examined by determining the extent of viscosity loss in a sonic breakdown test. The sonic breakdown test is a measure of shear stability and is conducted according to the procedure described in ASTM standards, vol. 1 (1961), p. 1160, "Test for Shear Stability of Polymer-Containing Oils." The results of these tests are summarized in Table I.

TABLE I

| Hydrogenated Polymer of Example* | KV at 210° F[1] cs | 0° F.[2] Vis.P. | Pour Pt[3] ° F. | Sonic[4] Shear % |
|---|---|---|---|---|
| 3 | 12.71 | 25.5 | −35 | 22.8 |
| 4 | 12.54 | 24.3 | 0 | 9.10 |

TABLE I-continued

| Hydrogenated Polymer of Example* | KV at 210° F[1] cs | 0° F.[2] Vis.P. | Pour Pt[3] ° F. | Sonic[4] Shear % |
|---|---|---|---|---|
| Paratone N | 12.4 | 28.9 | −37 | 22 |

*Additive is blended in an amount to provide a viscosity of the composition approximating 12.4 cs. at 210° F.
[1]Determined in accordance with ASTM D-445.
[2]Determined in accordance with ASTM D-2602.
[3]Determined in accordance with ASTM D-97.
[4]Run at 0.75 amps and 40° C. for 15 minutes according to ASTM standards, Vol. 1 (1961) page 1160.

The block copolymer (Example 3) of the invention has viscosity improving properties comparable to a commercial V.I, improver with comparable shear stability and pour point affect. The low temperature viscometrics provided by a blend of the copolymer of the invention to the lubricating oil containing a pour depressant are somewhat better than available from a copolymer containing large amounts of butadiene (the copolymer of Example 4) as evidenced by the 0° F. viscosity of each for the latter is 1.2 poises higher. It is submitted that such is surprising if one looks at Table II of U.S. Pat. No. 3,772,196 wherein Sample E without any butadiene content has a 0° F. viscosity of 6.8 poises lower than that of Sample H prepared from butadiene instead of isoprene, yet it has been found that an addition of 10% butadiene to the isoprene in the copolymer does not adversely affect the low temperature viscometrics.

A comparison of pour point affect between the block copolymer of the invention and one prepared in accordance with U.S. Pat. No. 3,795,615 will be seen from the following Table II wherein pour point data is presented using 4 control blends of diverse commercial pour point depressants in Solvent 150N Low Pour (pour point of −5° F.) mineral oil.

TABLE II

| Solvent 150N LP Plus 0.5 wt. % of | Pour Point[5] ° F. | | |
|---|---|---|---|
| | | 1.4 weight % of Polymer of | |
| | None | Example 3 | Example 4 |
| Paraflow 149[1] | −35 | −45 | −5 |
| Acryloid 150[2] | −30 | −45 | 0 |
| Hitec 672[3] | −40 | −45 | 0 |
| ECA 4384[4] | −40 | −40 | −10 |

[1]A wax/naphthalene condensation product available from Exxon Chemical Co. USA, Houston, Texas.
[2]An (~$C_{12}$) alkyl methacrylate polymer (ester base polymer) having at 210° F. viscosity of ~700 cs. available from Rohm and Haas Co., Philadelphia, Penna.
[3]An esterified and imidated styrene/maleic anhydride copolymer having an (Mn) of ~15,000 sold by Edwin Cooper Inc. of St. Louis, Missouri.
[4]A polymeric pour point depressant of a dialkyl fumarate-vinyl acetate copolymer sold by Exxon Chemical Co. USA of Houston, Texas.
[5]Determined in accordance with ASTM D-97.

Inspection of Table II demonstrates that the hydrogenated copolymer of Example 3 which contains about 8 mole % butadiene has markedly superior blend pour point activity than the hydrogenated copolymer of Example 4 which contains about 58 mole % of butadiene (the copolymer of U.S. Pat. No. 3,795,615). This pour point activity of the copolymer (containing a small amount of butadiene) of the invention in blends of commercial polymeric pour point depressants and mineral lubricating oil is unexpected in light of the data of Table I of the above-referenced U.S. Pat. No. 3,772,196. Specifically, a comparison of Samples B and C of Table I shows that a block copolymer of polystyrene-hydrogenated polyisoprene does not adversely affect the pour point of the compounded oil yet a copolymer of polystyrene-hydrogenated butadiene does markedly adversely affect the pour point by increasing it by 40°.

It is to be understood that the examples present in the foregoing specification are merely illustrative of this invention and are not intended to limit it in any manner; nor is the invention to be limited by any theory regarding its operability. The scope of the invention is to be determined by the appended claims.

What is claimed is:

1. In a lubricating oil composition comprising:
   a. a major amount of a mineral lubricating oil; and
   b. a minor but effective pour point depressing amount of a polymeric pour point depressant for said oil selected from the group consisting of
      i. long chain $C_{15}$ to $C_{60}$ alkyl aromatics wherein the aromatic may be a hydrocarbon or a hydroxy substituted hydrocarbon said aromatic containing a maximum of three said substituent groups, condensed rings, and mixtures thereof;
      ii. polymers comprising $C_8$ to $C_{20}$ alkyl esters of $C_3$ to $C_8$ mono- and dicarboxylic monoethylenically unsaturated acids; and
      iii. copolymers comprising styrene and maleic anhydride esterfied with $C_2$ to $C_{26}$ alcohol; the improvement of including
   c. 0.1–10 percent by weight of an oil soluble hydrogenated block terpolymer viscosity index improver compatible with said pour point depressant, so as not to unduly interfere with the pour depressing action of said pour point depressant, said terpolymer having the structure $$(A)_x(B)_y(C)_z$$

wherein:

A is a conjugated diene of the formula $$CH_2{=}CH{-}\overset{\overset{R}{|}}{C}{=}CH_2$$

wherein R is a $C_1$ to $C_8$ alkyl group and present in mole % proportion as indicated by $x$ which may vary from 45 to 99 mole %;

B is butadiene and present in mole % proportion as indicated by $y$ which may vary from about 2 to about 9 mole %; and, C is a $C_8$ to $C_{20}$ monovinyl aromatic hydrocarbon monomer, and present in mole % proportion as indicated by $z$ which may vary from 5 to 40 mole %; said block terpolymer being prepared by copolymerizing A and B to form a first block, and then copolymerizing C to form a second block and wherein about 75 to 95% of the diene monomers are in the 1,4-configuration.

2. In the composition of claim 1 wherein said terpolymer has a number average molecular weight in the range of about 15,000 to about 200,000; wherein said conjugated diene is isoprene, said aromatic monomer is styrene and substantially all of the olefinic bonds are saturated by hydrogenation.

3. In the composition of claim 2 wherein the ($\overline{M}n$) of said block terpolymer ranges between 10,000 and 150,000.

4. In the composition of claim 2 wherein in said block terpolymer said isoprene is present in an amount ranging from about 90 to 99 mole percent, and at least 95% of the olefinic double bonds but not more than 5% of the aromatic unsaturated double bonds have been saturated.

5. In the composition of claim 3 wherein said polymeric pour point depressant is said alkyl aromatic.

6. In the composition of claim 3 wherein said polymeric pour point depressant is said polymer of $C_8$–$C_{20}$ alkyl ester.

7. In the composition of claim 3 wherein said polymeric pour point depressant is said copolymer of styrene and esterified maleic anhydride.

8. In the composition of claim 5 wherein said pour point depressant is wax alkylated naphthalene and said block terpolymer contains about 8 mole % butadiene, 85 mole % isoprene and 7 mole % styrene.

9. In the composition of claim 6 wherein said pour point depressant comprises essentially $C_{12}$ alkyl methacrylate polymer and said block terpolymer contains about 8 mole % butadiene, about 85 mole % isoprene and about 7 mole % styrene.

10. In the composition of claim 6 wherein said pour point depressant is a dialkyl fumarate-vinyl acetate copolymer and said block copolymer contains about 8 mole % butadiene, about 85 mole % isoprene and about 7 mole % styrene.

11. In the composition of claim 7 wherein said pour point depressant is an esterified and imidated styrene/maleic anhydride copolymer having an ($\overline{M}n$) of about 15,000 and said block terpolymer contains about 8 mole % butadiene, about 85 mole % isoprene and about 7 mole % styrene.

* * * * *